US007051374B1

(12) United States Patent
Grilliot et al.

(10) Patent No.: US 7,051,374 B1
(45) Date of Patent: May 30, 2006

(54) PROTECTIVE ENSEMBLE EMPLOYING MAGNETICALLY ATTRACTABLE AND MAGNETIC GASKETS BETWEEN PROTECTIVE GARMENT AND OTHER PROTECTIVE ITEM

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/033,673

(22) Filed: Jan. 12, 2005

(51) Int. Cl.
*A41D 13/00* (2006.01)

(52) U.S. Cl. ..... 2/69

(58) Field of Classification Search ..... 2/455, 2/456, 46, 59, 69, 69.5, 16, 84, 79, 227, 85, 2/123, 70, 124, 94, 126, 93, 102, 159, 160, 2/82

See application file for complete search history.

(56) References Cited

U.S. PATENT DOCUMENTS 3,889,297 A * 6/1975 Jarboe et al. ..... 2/16
4,644,698 A 2/1987 Gerdes et al.
4,766,613 A * 8/1988 Wells ..... 2/227
4,891,912 A 1/1990 Bockwinkel
5,117,587 A 6/1992 Doan
5,129,184 A 7/1992 Fish
5,182,812 A * 2/1993 Goldsby ..... 2/79
5,749,098 A * 5/1998 Evans ..... 2/123
6,038,700 A 3/2000 Aldridge et al.

* cited by examiner

*Primary Examiner*—Tejash Patel
(74) *Attorney, Agent, or Firm*—Wood, Phillips, Katz, Clark & Mortimer

(57) ABSTRACT

In a protective ensemble for a firefighter or for an emergency rescue worker, a distal portion of a limb-covering, torso-covering, or head-covering region of a protective garment surrounds a portion of a protective item worn with the protective garment. A gasket extending around and inside of the distal portion of the limb-covering, torso-covering, or head-covering region and a gasket extending around and outside the surrounded portion of the protective item worn with the protective garment engage each other. A given one of the gaskets is magnetic and the other one of the gaskets is magnetically attractable. The magnetic gasket comprises a magnetic strip, which is covered by an elastomeric sleeve. The magnetically attractable gasket comprises a magnetically attractable strip, which is covered by an elastomeric sleeve.

11 Claims, 4 Drawing Sheets

PROTECTIVE ENSEMBLE EMPLOYING MAGNETICALLY ATTRACTABLE AND MAGNETIC GASKETS BETWEEN PROTECTIVE GARMENT AND OTHER PROTECTIVE ITEM

TECHNICAL FIELD OF THE INVENTION

This invention pertains to a protective ensemble comprising a protective garment having a limb-covering, torso-covering, or head-covering region, such as a protective coat, a protective pullover, protective coveralls, protective trousers, or a protective hood, and a protective item, which is worn with the protective garment and which may be a protective glove, a protective boot, a pair of protective trousers, or a protective facemask, for a firefighter or for an emergency rescue worker. This invention contemplates that magnetically attractable and magnetic gaskets are employed between the limb-covering, torso-covering, or head-covering region of the protective garment and the protective item.

BACKGROUND OF THE INVENTION

As exemplified in U.S. Pat. No. 6,038,700, it has been known to treat a wristlet on each sleeve of a protective coat for a firefighter with a water-repellant finish. Such wristlets may not be fully effective to prevent potentially harmful liquids and potentially harmful particles from entering the sleeves and may be largely ineffective to prevent potentially harmful gases from entering the sleeves.

As exemplified in U.S. Pat. No. 4,644,698, No. 4,891,912, No. 5,117,587, and No. 5,129,184, magnetic gaskets are employed for unrelated uses in unrelated fields. Moreover, a composite substrate having a magnetic layer, for unrelated uses in an unrelated field, is exemplified in U.S. Pat. No. 6,387,485 B1. Heretofore, magnetic gaskets and composite substrates, as exemplified in those patents, have not been employed in connection with protective garments for firefighters or for emergency rescue workers or in connection with other protective items, such as protective gloves, protective boots, or protective facemasks for firefighters or for emergency rescue workers.

SUMMARY OF THE INVENTION

This invention provides, for a firefighter or for an emergency rescue worker, a protective ensemble comprising a protective garment having a limb-covering, torso-covering, or head-covering region and a protective item, which is worn with the protective garment, wherein the limb-covering, torso-covering, or head-covering portion has a distal portion that surrounds a portion of the protective item when the protective glove and the protective garment having the protective sleeve are worn.

If the protective garment is a protective coat, the protective item worn with the protective garment may be a protective glove, whereupon the protective garment has a limb-covering region, which is a sleeve of the protective coat. If the protective garment is a protective coat, the protective item worn with the protective garment may be a pair of protective trousers, whereupon the protective garment has a torso-covering region. If the protective garment is a pair of protective trousers, the protective item worn with the protective garment may be a protective boot, whereupon the protective garment has a limb-covering region, which is a leg-covering region. If the protective garment is a protective hood, the protective item worn with the protective garment may be a protective facemask, whereupon the protective garment has a head-covering region.

This invention contemplates that the protective item has a gasket extending around an outer surface of the portion that is surrounded by the distal portion of the protective garment when the protective item and the protective garment having the protective sleeve are worn, that the limb-covering, torso-covering, or head-covering region of the protective garment has a gasket extending around an inner surface of the distal portion, and that the gaskets are adapted to engage each other when the protective item and the protective garment having the protective sleeve are worn. This invention further contemplates that a given one of the gaskets is magnetic and that the other one of the gaskets is magnetically attractable.

Preferably, the magnetic gasket comprises a magnetic strip, which is covered by an elastomeric sleeve, and the magnetically attractable gasket comprises a magnetically attractable strip, which is covered by an elastomeric sleeve.

DETAILED DESCRIPTION OF THE ILLUSTRATED EMBODIMENTS

Figure 1:
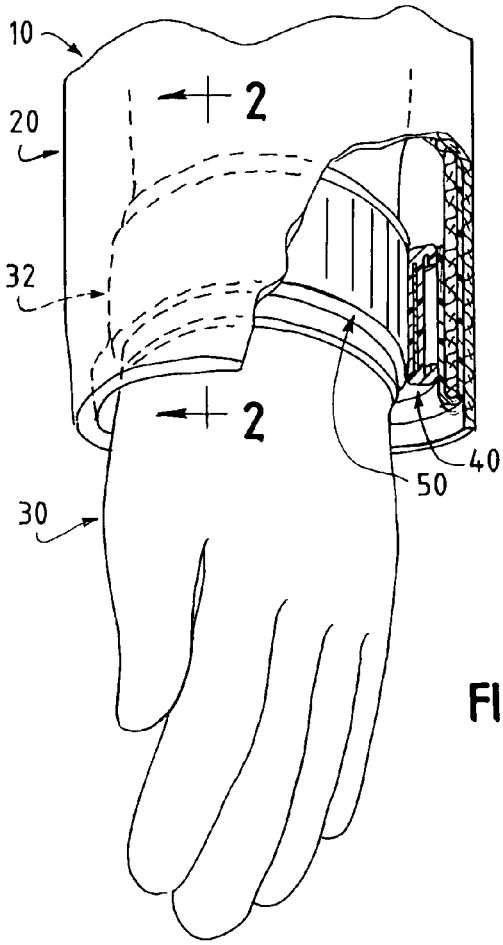
FIG. 1 is a fragmentary, partly broken away, pictorial view illustrating a distal portion of one sleeve of a protective coat, a protective glove worn with the protective coat, and magnetically attractable and magnetic gaskets between the distal portion of the sleeve and a surrounded portion of the protective glove.
Figure 2:
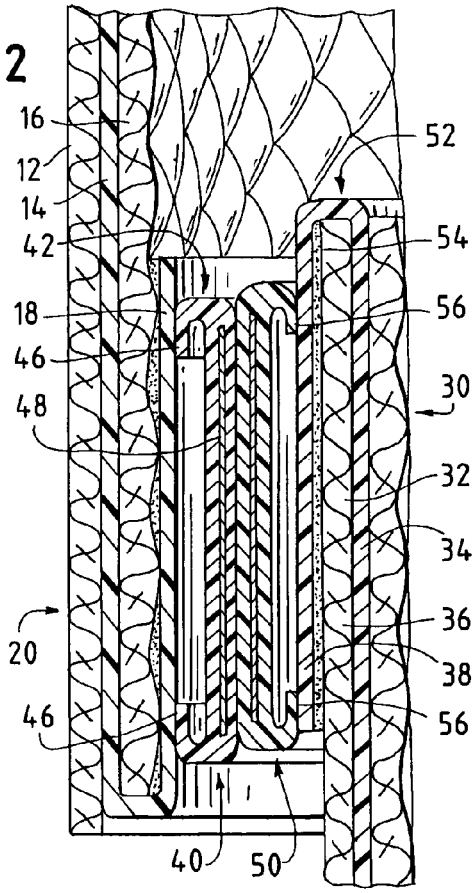
FIG. 2 is a sectional view, as taken along line 2—2 of FIG. 1, in a direction indicated by arrows.

As illustrated in FIGS. 1 and 2, a protective ensemble for a firefighter or for an emergency rescue worker comprises a protective coat 10 having a sleeve 20, which is one of a pair of sleeves, and a protective glove 30, which is one of a pair of protective gloves worn with the protective coat 10. The protective coat 10, which includes the sleeve 20, has an outer, fabric shell 12, an intermediate liner 14 providing a moisture barrier or a moisture and chemical barrier, and an inner, quilted liner 16 providing a thermal barrier and, thus, conforms to protective coats known heretofore for firefighters and for emergency rescue workers. The protective glove 30 has an outer shell 32, which may be made of fabric or leather, an intermediate liner 34 providing a moisture barrier or a moisture and chemical barrier, and an inner, fabric liner 36 and, thus, conforms to protective gloves known heretofore for firefighters and for emergency rescue workers. When the protective coat 10 and the protective glove 30 are worn, a distal portion of the sleeve 20 of the protective coat 10 surrounds a wrist-encircling portion of the protective glove 30.

As contemplated by this invention, a gasket 40 extends around and inside and is fastened suitably to the distal portion 22 of the sleeve 20 of the protective coat 10. The gasket 40 comprises a sleeve 42 of a suitable, elastomeric polymer, a magnetic or magnetically attractable strip 44 embedded within the sleeve 42, and two wings 46 extending from the sleeve 42, folded over so as to space the sleeve 42 from the sleeve 20 of the protective coat 10, and fastened, as described above.

Figure 2A:
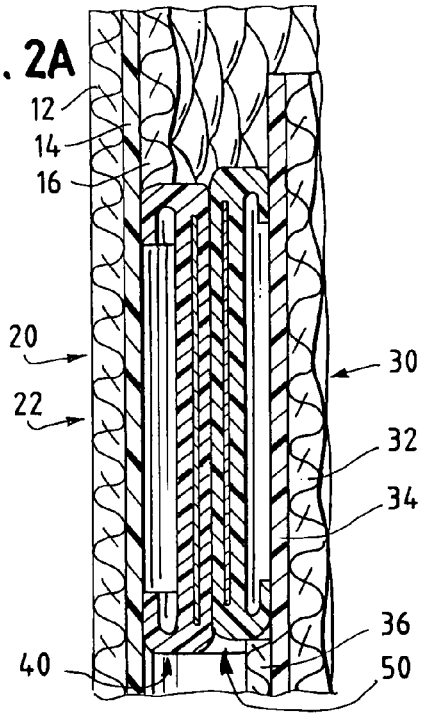
FIG. 2A is a similar view illustrating an alternative embodiment of this invention.

Preferably, as illustrated in FIGS. 1 and 2, the protective coat 10 is made so that, at the sleeve 20, the intermediate liner 14 has a portion 18, which extends beyond the inner liner 16, which is folded into the inner liner 16, and which is fastened adhesively, by stitching, or adhesively and by stitching to the inner liner 16, and the gasket 40 is fastened adhesively, by welding, or otherwise to the liner portion 18. Alternatively, as illustrated in FIG. 2A, the inner liner 16 is shortened so as to permit the gasket 40 to be directly fastened adhesively, by welding, or otherwise to the intermediate liner 14.

As contemplated by this invention, a gasket 50 extends around and outside and is fastened adhesively, by stitching, or adhesively and by stitching to the protective glove 30. The gasket 50 comprises a sleeve 52 of a suitable, elastomeric polymer, a magnetic or magnetically attractable strip 54 embedded within the sleeve 52, and two wings 56 extending from the sleeve 52, folded over so as to space the sleeve 52 from the outer surface 34 of the protective glove 30, and fastened, as described above.

Preferably, as illustrated in FIGS. 1 and 2, the protective glove 30 is made so that the intermediate liner 34 has a portion 38, which extends beyond the inner liner 16, which is folded over the outer shell 32, and which is fastened adhesively, by stitching, or adhesively and by stitching to the outer shell 32, and the gasket 40 is fastened adhesively, by welding, or otherwise to the liner portion 38. Alternatively, as illustrated in FIG. 2A, the inner liner 36 is shortened so as to permit the gasket 40 to be directly fastened adhesively, by welding, or otherwise to the intermediate liner 34.

A given one of the embedded strips 44, 54, of the gaskets 40, 50, is magnetic and may be a magnetized, metallic strip, either continuous or divided into multiple segments, or a polymeric strip, in which magnetized particles are embedded. The other one of the embedded strips 44, 54, of the gaskets 40, 50, is magnetically attractable and may be a metallic strip, either continuous or divided into multiple segments, a strip of metallic mesh, or a polymeric strip, in which metallic particles are embedded.

Figure 3:
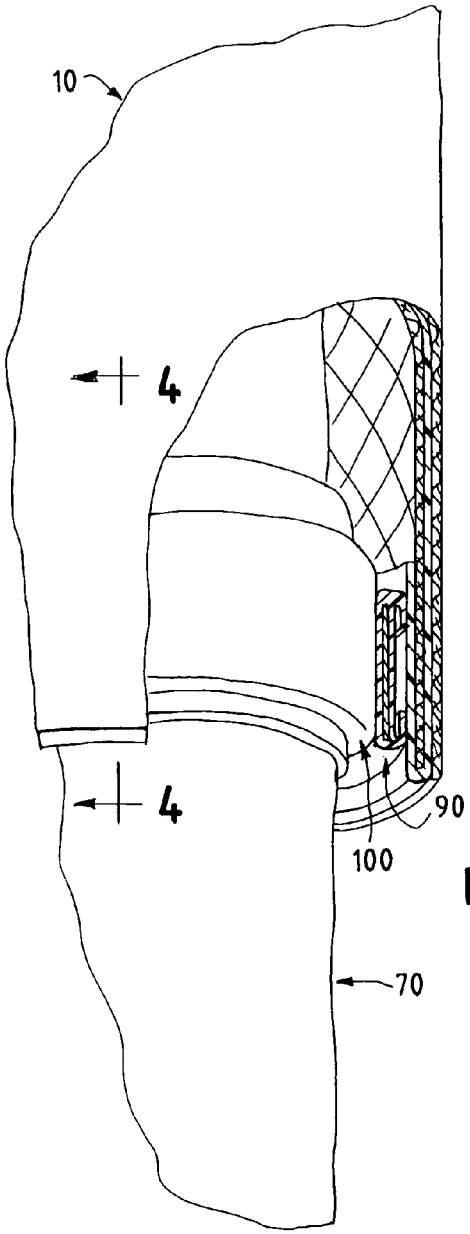
FIG. 3 is a fragmentary, partly broken away, pictorial view illustrating a distal portion of a torso-covering region of the protective coat, a pair of protective trousers worn with the protective coat, and magnetically attractable and magnetic gaskets between the distal portion of the torso-covering region of the protective coat and a surrounded portion of the pair of protective trousers.
Figure 4:
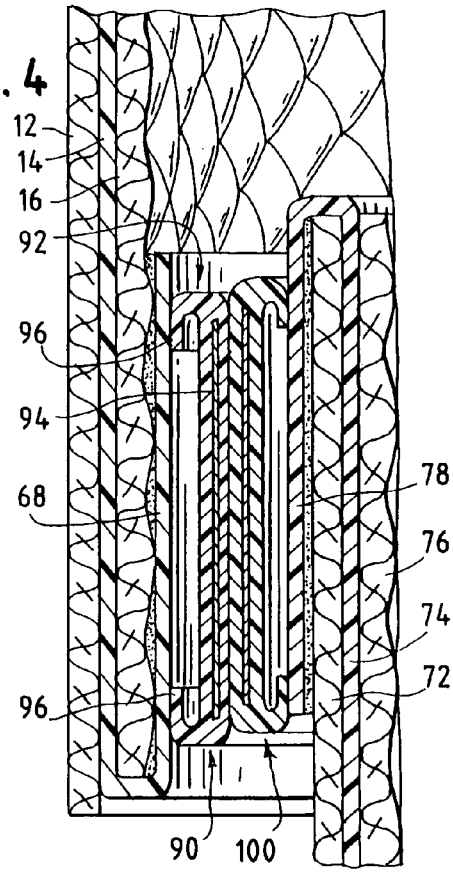
FIG. 4 is a sectional view, as taken along line 4—4 of FIG. 3, in a direction indicated by arrows.

As illustrated in FIGS. 3 and 4, the protective ensemble for a firefighter or for an emergency rescue worker comprises the protective coat 10 having a torso-covering region, and a pair of protective trousers 70, which is worn with the protective coat 10. The protective coat 10, as described previously, has an outer, fabric shell 12, an intermediate liner 14 providing a moisture barrier or a moisture and chemical barrier, and an inner, quilted liner 16 providing a thermal barrier. The pair of protective trousers 70 has an outer shell 72, an intermediate liner 74 providing a moisture barrier or a moisture and chemical barrier, and an inner, quilted liner 76 providing a thermal and, thus, conforms to pairs of protective trousers known heretofore for firefighters and for emergency rescue workers. When the protective coat 10 and the pair of protective trousers 70 are worn, a distal portion 62 of the torso-covering region of the protective coat 10 surrounds a waist-encircling portion of the pair of protective trousers 70.

As contemplated by this invention, a gasket 90 extends around and inside and is fastened suitably to the torso-covering region 60 of the protective coat 10. The gasket 90 comprises a sleeve 92 of a suitable, elastomeric polymer, a magnetic or magnetically attractable strip 94 embedded within the sleeve 92, and two wings 96 extending from the sleeve 92, folded over so as to space the sleeve 92 from the sleeve 20 of the protective coat 10, and fastened, as described above.

Figure 4A:
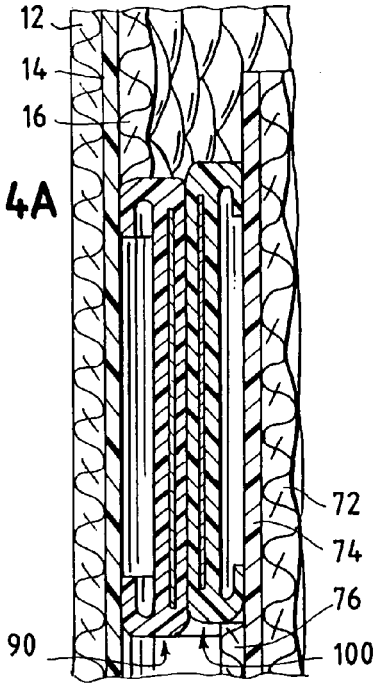
FIG. 4A is a similar view illustrating an alternative embodiment of this invention.

Preferably, as illustrated in FIGS. 3 and 4, the protective coat 10 is made so that, at the torso-covering region 60, the intermediate liner 14 has a portion 68, which extends beyond the inner liner 16, which is folded over the outer shell 12, and which is fastened adhesively, by stitching, or adhesively and by stitching to the outer shell 12, and the gasket 90 is fastened adhesively, by welding, or otherwise to the liner portion 68. Alternatively, as illustrated in FIG. 4A, the inner liner 16 is shortened so as to permit the gasket 90 to be directly fastened adhesively, by welding, or otherwise to the intermediate liner 14.

As contemplated by this invention, a gasket 100 extends around and outside and is fastened suitably to the waist-encircling portion 80 of the pair of protective trousers 70. The gasket 100 comprises a sleeve 102 of a suitable, elastomeric polymer, a magnetic or magnetically attractable strip 104 embedded within the sleeve 102, and two wings 106 extending from the sleeve 102, folded over so as to space the sleeve 102 from the outer surface 74 of the outer shell 72 of the pair of protective trousers 70, and fastened, as described above.

Preferably, as illustrated in FIGS. 3 and 4, the pair of protective trousers 70 is made so that, at the waist-3encircling portion 80, the intermediate liner 74 has a portion 78, which extends beyond the inner liner 76, which is folded over the outer shell 72, and which is fastened adhesively, by stitching, or adhesively and by stitching to the outer shell 72, and the gasket 100 is fastened adhesively, by welding, or otherwise to the liner portion 78. Alternatively, as illustrated in FIG. 4A, the inner liner 76 is shortened so as to permit the gasket 100 to be directly fastened adhesively, by welding, or otherwise to the intermediate liner 74.

A given one of the embedded strips 94, 104, of the gaskets 90, 100, is magnetic and may be a magnetized, metallic strip, either continuous or divided into multiple segments, or a polymeric strip, in which magnetized particles are embedded. The other one of the embedded strips 94, 104, of the gaskets 90, 100, is magnetically attractable and may be a metallic strip, either continuous or divided into multiple segments, a strip of metallic mesh, or a polymeric strip, in which metallic particles are embedded.

Figure 5:
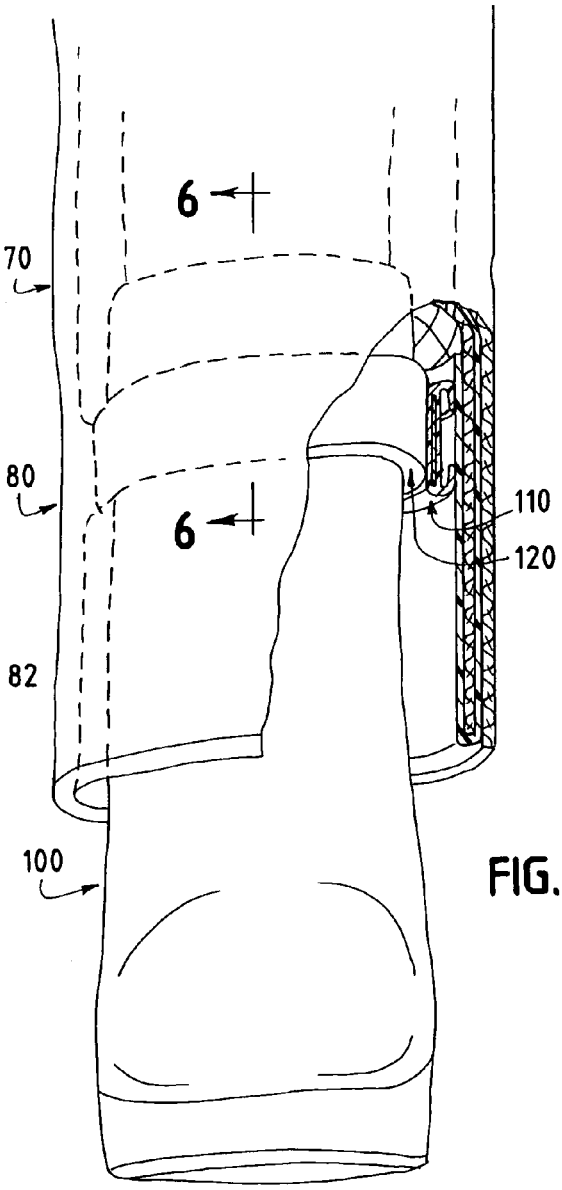
FIG. 5 is a fragmentary, partly broken away, pictorial view illustrating a distal portion of one leg-covering region of the pair of protective trousers, a protective boot worn with the pair of protective trousers, and magnetically attractable and magnetic gaskets between the distal portion of the leg-covering region of the pair of protective trousers and a surrounded portion of the protective boot.
Figure 6:
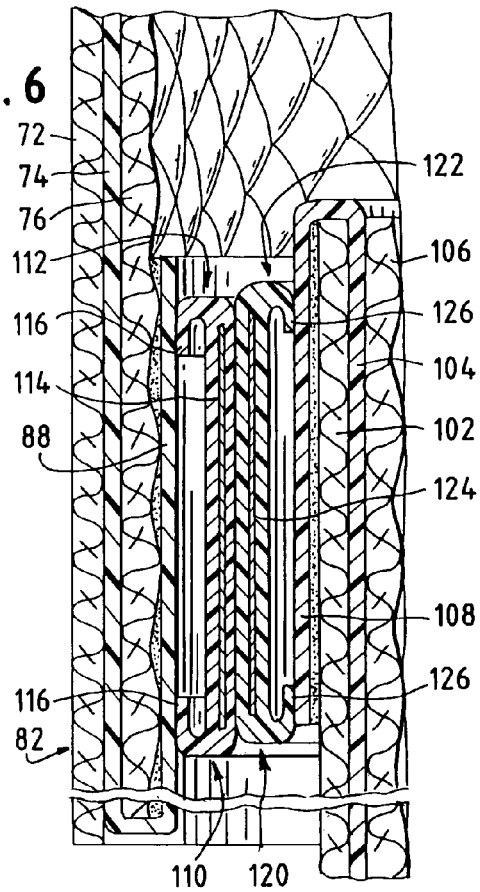
FIG. 6 is a sectional view, as taken along line 6—6 of FIG. 5, in a direction indicated by arrows.

As illustrated in FIGS. 5 and 6, the protective ensemble for a firefighter or for an emergency rescue worker comprises the pair of protective trousers 70, which has a leg-covering region 80, and a protective boot 100, which is worn with the pair of protective trousers 70. The pair of protective trousers 70, as described above, has the outer, fabric shell 72, an intermediate liner 74 providing a moisture barrier or a moisture and chemical barrier, and an inner, quilted liner 76 providing a thermal barrier. The protective boot 100 has an outer shell 102, which is made of leather, rubber, or rubberized fabric, an intermediate liner 104, which provides a moisture barrier or a moisture and chemical barrier, and an inner, fabric liner 106 and, thus, conforms to protective boots known heretofore for firefighters and for emergency rescue workers. When the pair of protective trousers 70 and the protective boot 80 are worn, a distal portion 82 of the leg-covering region 80 of the pair of protective trousers 70 surrounds an ankle-encircling portion of the protective boot 100.

As contemplated by this invention, a gasket 110 extends around and inside and is fastened suitably to the leg-covering region 80 of the pair of protective trousers 70. The gasket 110 comprises a sleeve 112 of a suitable, elastomeric polymer, a magnetic or magnetically attractable strip 114 embedded within the sleeve 112, and two wings 116 extending from the sleeve 112, folded over so as to space the sleeve 112 from the inner surface 24 of the inner liner 16 of the sleeve 20 of the protective coat 10, and fastened, as described above.

Figure 6A:
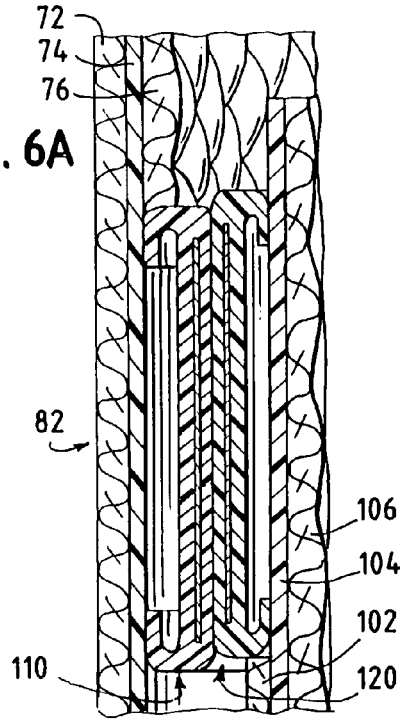

Preferably, as illustrated in FIGS. 5 and 6, the pair of protective trousers 70 is made so that, at the leg-covering region 80, the intermediate liner 74 has a portion 88, which extends beyond the inner liner 76, which is folded over the outer shell 72, and which is fastened adhesively, by stitching, or adhesively and by stitching to the outer shell 72, and the gasket 110 is fastened adhesively, by welding, or otherwise to the liner portion 88. Alternatively, as illustrated in FIG. 6A, the inner liner 76 is shortened so as to permit the gasket 110 to be directly fastened adhesively, by welding, or otherwise to the intermediate liner 74.

As contemplated by this invention, a gasket 120 extends around and outside and is fastened suitably to the ankle-encircling portion of the protective boot 100. The gasket 120 comprises a sleeve 122 of a suitable, elastomeric polymer, a magnetic or magnetically attractable strip 124 embedded within the sleeve 122, and two wings 126 extending from the sleeve 122, folded over so as to space the sleeve 122 from the outer surface 74 of the outer shell 72 of the pair of protective trousers 70, and fastened, as described above.

Preferably, as illustrated in FIGS. 5 and 6, the protective boot 100 is made so that the intermediate liner 104 has a portion 108, which extends beyond the inner liner 106, which is folded over the outer shell 102, and which is fastened adhesively, by stitching, or adhesively and by stitching to the outer shell 102, and the gasket 120 is fastened adhesively, by welding, or otherwise to the liner portion 108. Alternatively, as illustrated in FIG. 6A, the inner liner 106 is shortened so as to permit the gasket 120 to be directly fastened adhesively, by welding, or otherwise to the intermediate liner 104.

A given one of the embedded strips 114, 124, of the gaskets 110, 120, is magnetic and may be a magnetized, metallic strip, either continuous or divided into multiple segments, or a polymeric strip, in which magnetized particles are embedded. The other one of the embedded strips 114, 124, of the gaskets 110, 120, is magnetically attractable and may be a metallic strip, either continuous or divided into multiple segments, a strip of metallic mesh, or a polymeric strip, in which metallic particles are embedded.

Figure 7:
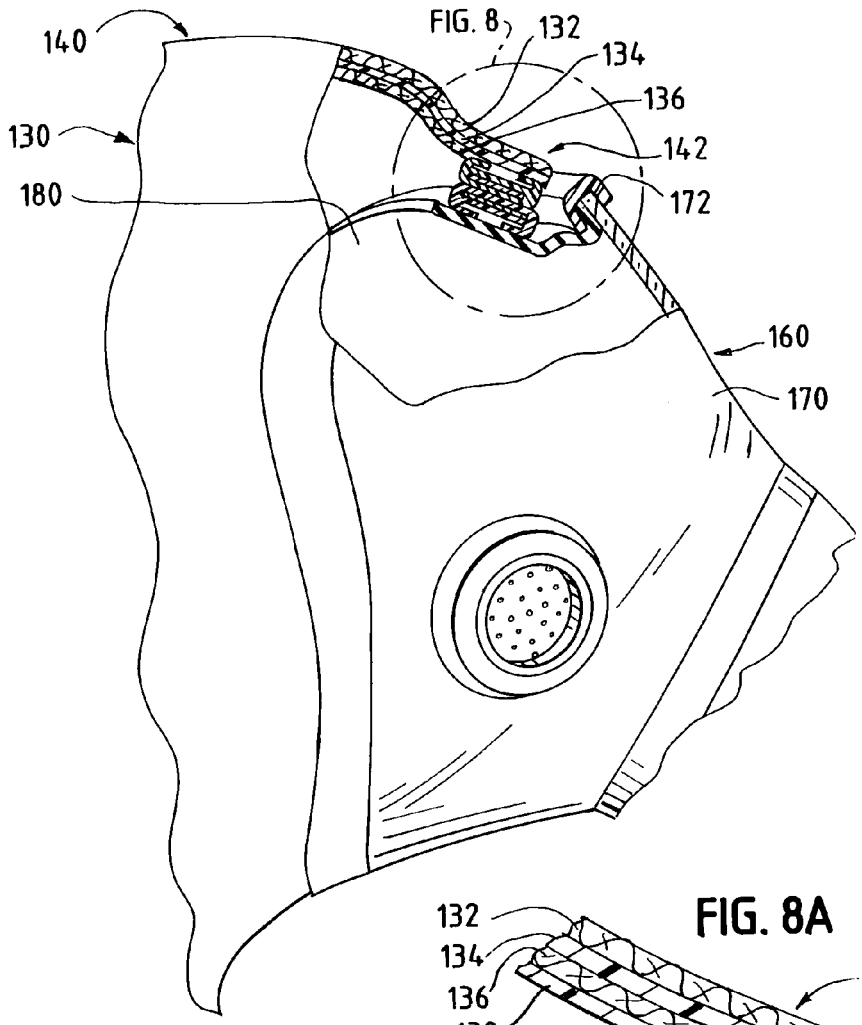
FIG. 7 is a fragmentary, partly broken away, pictorial view illustrating a distal portion of a head-covering region of a protective hood, a protective facemask worn with the protective hood, and magnetically attractable and magnetic gaskets between the distal portion of the head-covering region of the protective hood and a surrounded portion of the protective facemask.
Figure 8A:
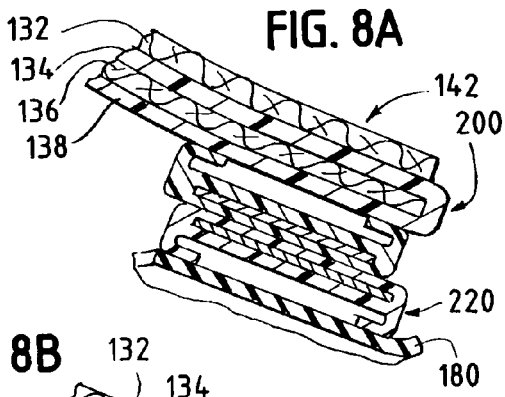
FIGS. 8A and 8B are comparable details illustrating alternative embodiments of this invention.
Figure 8:
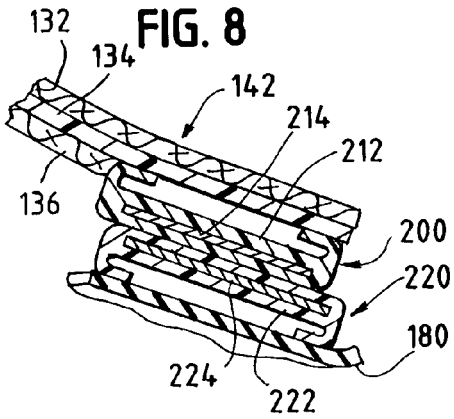
FIG. 8, on a larger scale, is a fragmentary detail taken in a similarly numbered region outlined in FIG. 7.

As illustrated in FIGS. 7 and 8, the protective ensemble for a firefighter or for an emergency rescue worker comprises a protective hood 130, which has a head-covering region 140, and a protective facemask 160, which is worn with the protective hood 130. The protective hood 130 has an outer, fabric shell 132, an intermediate liner 134 providing a moisture barrier or a moisture and chemical barrier, and an inner, fabric liner 136 and, thus, conforms to protective hoods known heretofore for firefighters or for emergency rescue workers. The protective facemask 160, which is used with a self-contained breathing apparatus (SCBA) or with a respirator having an air filter, has a transparent window 170 and a face-conforming gasket 180 mounting a rear edge 172 of the transparent window 170 and, thus, conforms to protective facemasks known heretofore for firefighters or for emergency rescue workers. When the protective hood 130 and the protective facemask 160 are worn, a distal portion 142 of the head-covering region 140 of the protective hood 130 surrounds the face-conforming gasket 180 of the protective facemask 160.

As contemplated by this invention, a gasket 200 extends around and inside and is fastened suitably to the distal portion 142 of the head-covering region 140 of the protective hood 130. The gasket 200 comprises a sleeve 212 of a suitable, elastomeric polymer, a magnetic or magnetically attractable strip 214 embedded within the sleeve 112, and two wings 216 extending from the sleeve 212, folded over so as to space the sleeve 212 from the protective hood 130, and fastened, as described above.

Figure 8B:
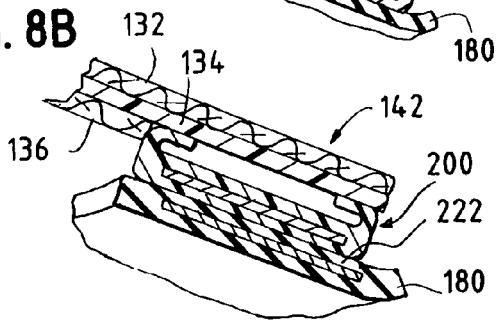

As illustrated in FIGS. 7 and 8, the inner liner 136 of the protective hood 130 is shortened so as to permit the gasket 200 to be directly fastened adhesively, by welding, or otherwise to the intermediate liner 134. Alternatively, as illustrated in FIG. 8B, the intermediate liner 134 has a portion 138, which extends beyond the inner liner 136, which is folded under the inner liner 136, and which is fastened adhesively, by stitching, or adhesively and by stitching to the inner liner 136, and the gasket 200 is fastened adhesively, by welding, or otherwise to the liner portion 138.

As contemplated by this invention, and as illustrated in FIGS. 7 and 8, a gasket 220 extends around and outside and is fastened adhesively, by stitching, or adhesively and by stitching to the face-conforming gasket 180 of the protective facemask 160. The gasket 220 comprises a sleeve 222 of a suitable, elastomeric polymer, a magnetic or magnetically attractable strip 224 embedded within the sleeve 112, and two wings 226 extending from the sleeve 222, folded over so as to space the sleeve 222 from the face-conforming gasket 180, and fastened, as described above. The sleeve 222 provides an elastomeric wall 228 between the embedded strip 224 and the face-conforming gasket 180. Alternatively, as illustrated in FIG. 8B, the sleeve 222 is a unitary part of the face-conforming gasket 180, there being no wings similar to the wings 226.

A given one of the embedded strips 214, 224, of the gaskets 210, 220, is magnetic and may be a magnetized, metallic strip, either continuous or divided into multiple segments, or a polymeric strip, in which magnetized particles are embedded. The other one of the embedded strips 214, 224, of the gaskets 210, 220, is magnetically attractable and may be a metallic strip, either continuous or divided into multiple segments, a strip of metallic mesh, or a polymeric strip, in which metallic particles are embedded.

Advantageously, the gaskets 40, 50, the gaskets 90, 100, the gaskets 110, 120, and the gaskets 210, 220, when drawn together magnetically, provide fluid-tight seals, which impede potentially harmful liquids, particles, and gases from entering the protective coat 10, the pair of protective trousers 70, or the protective hood 130.

The invention claimed is:

1. For a firefighter or for an emergency rescue worker, a protective ensemble comprising a protective item and a protective garment having a limb-covering, torso-covering, or head-covering region, which has a distal portion that surrounds a portion of the protective item when the protective item and the protective garment are worn, wherein the protective item has a gasket extending around and outside the item portion that is surrounded by the distal portion when the protective item and the protective garment having the protective sleeve are worn, the protective sleeve has a gasket extending around and inside the distal portion, and the gaskets are adapted to engage each other when the protective item and the protective garment having the protective sleeve are worn, and wherein a given one of the gaskets is magnetic and the other one of the gaskets is magnetically attractable.

2. The protective ensemble of claim 1, wherein the magnetic gasket comprises a magnetic strip, which is covered by an elastomeric sleeve, and wherein the magnetically attractable gasket comprises a magnetically attractable strip, which is covered by an elastomeric sleeve.

3. For a firefighter or for an emergency rescue worker, a protective ensemble comprising a protective glove and a protective coat having a sleeve, which has a distal portion that surrounds a portion of the protective glove when the protective glove and the protective coat are worn, wherein the protective glove has a gasket extending around and outside the glove portion that is surrounded by the distal portion when the protective glove and the protective coat are worn, the sleeve has a gasket extending around and inside the distal portion, and the gaskets are adapted to engage each other when the protective glove and the protective coat are worn, and wherein a given one of the gaskets is magnetic and the other one of the gaskets is magnetically attractable.

4. The protective ensemble of claim 3, wherein the magnetic gasket comprises a magnetic strip, which is covered by an elastomeric sleeve, and wherein the magnetically attractable gasket comprises a magnetically attractable strip, which is covered by an elastomeric sleeve.

5. For a firefighter or for an emergency rescue worker, a protective ensemble comprising a pair of protective trousers and a protective coat having a torso-covering region, which has a distal portion that surrounds a portion of the pair of protective trousers when the pair of protective trousers and the protective coat are worn, wherein the pair of protective trousers has a gasket extending around and outside the trousers portion that is surrounded by the distal portion when the pair of protective trousers and the protective coat are worn, the torso-covering region has a gasket extending around and inside the distal portion, and the gaskets are adapted to engage each other when the pair of protective trousers and the protective coat are worn, and wherein a given one of the gaskets is magnetic and the other one of the gaskets is magnetically attractable.

6. The protective ensemble of claim 5, wherein the magnetic gasket comprises a magnetic strip, which is covered by an elastomeric, and wherein the magnetically attractable gasket comprises a magnetically attractable strip, which is covered by an elastomeric sleeve.

7. For a firefighter or for an emergency rescue worker, a protective ensemble comprising a protective boot and a pair of protective trousers having a torso-covering region, which has a distal portion that surrounds a portion of the protective boot when the protective boot and the pair of protective trousers are worn, wherein the protective boot has a gasket extending around and outside an outer surface of the boot portion that is surrounded by the distal portion when the pair of protective trousers and the protective coat are worn, the leg-covering region has a gasket extending around and inside the distal portion, and the gaskets are adapted to engage each other when the protective boot and the pair of protective trousers are worn, and wherein a given one of the gaskets is magnetic and the other one of the gaskets is magnetically attractable.

8. The protective ensemble of claim 7, wherein the magnetic gasket comprises a magnetic strip, which is covered by an elastomeric sleeve, and wherein the magnetically attractable gasket comprises a magnetically attractable strip, which is covered by an elastomeric sleeve.

9. For a firefighter or for an emergency rescue worker, a protective ensemble comprising a protective facemask and a protective hood having a torso-covering region, which has a distal portion that surrounds a portion of the protective facemask when the protective facemask and the protective hood are worn, wherein the protective facemask has a gasket extending around and outside the facemask portion that is surrounded by the distal portion when the protective facemask and the protective hood are worn, the leg-covering region has a gasket extending around and inside the distal portion, and the gaskets are adapted to engage each other when the protective facemask and the protective hood are worn, and wherein a given one of the gaskets is magnetic and the other one of the gaskets is magnetically attractable.

10. The protective ensemble of claim 9, wherein the magnetic gasket comprises a magnetic strip, which is covered by an elastomeric sleeve, and wherein the magnetically attractable gasket comprises a magnetically attractable strip, which is covered by an elastomeric sleeve.

11. The protective ensemble of claim 10, wherein one said sleeve is unitary with the surrounded portion of the protective facemask.

* * * * *

UNITED STATES PATENT AND TRADEMARK OFFICE

CERTIFICATE OF CORRECTION

PATENT NO. : 7,051,374 B1
APPLICATION NO. : 11/033673
DATED : May 30, 2006
INVENTOR(S) : William L. Grilliot and Mary I. Grilliot It is certified that error appears in the above-identified patent and that said Letters Patent is hereby corrected as shown below:

The following heading and the following statement should be printed in column 1, between the title of the invention and the heading TECHNICAL FIELD OF THE INVENTION:

STATEMENT REGARDING FEDERALLY SPONSORED RESEARCH OR DEVELOPMENT

This invention was made with Government support under Contract No. W91CRB-04-C-027 awarded by the United States Department of the Army. The Government has certain rights in the invention.

Signed and Sealed this

First Day of August, 2006

JON W. DUDAS
*Director of the United States Patent and Trademark Office*